US009069278B2

(12) United States Patent
Adachi et al.

(10) Patent No.: US 9,069,278 B2
(45) Date of Patent: Jun. 30, 2015

(54) IMAGE FORMING APPARATUS HAVING NON-IMAGE PORTION EXPOSURE AMOUNT THAT IS LOWER IN MONO MODE THAN IN COLOR MODE

(71) Applicant: CANON KABUSHIKI KAISHA, Tokyo (JP)

(72) Inventors: Motoki Adachi, Ashigarakami-gun (JP); Hideaki Hasegawa, Suntou-gun (JP); Takayoshi Kihara, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 174 days.

(21) Appl. No.: 13/866,919

(22) Filed: Apr. 19, 2013

(65) Prior Publication Data

US 2014/0003829 A1 Jan. 2, 2014

(30) Foreign Application Priority Data

Apr. 24, 2012 (JP) ..... 2012-098870

(51) Int. Cl.

*G03G 15/08* (2006.01)
*G03G 15/01* (2006.01)
*G03G 15/00* (2006.01)

(52) U.S. Cl.

CPC ..... *G03G 15/0189* (2013.01); *G03G 15/50* (2013.01)

(58) Field of Classification Search

CPC ..... G03G 15/0189; G03G 15/50
USPC ..... 399/39, 40, 51, 54, 177, 223, 298, 299, 399/302
See application file for complete search history.

(56) References Cited

U.S. PATENT DOCUMENTS 8,831,444 B2 * 9/2014 Shimura et al. ..... 399/177

FOREIGN PATENT DOCUMENTS

| | | | |
|---|---|---|---|
| JP | 8-171260 | A | 7/1996 |
| JP | 2008-8991 | A | 1/2008 |
| JP | 2012-037662 | A | 2/2012 |

* cited by examiner

*Primary Examiner* — William J Royer
(74) *Attorney, Agent, or Firm* — Canon U.S.A., Inc. IP Division

(57) ABSTRACT

An image forming apparatus can switch between a color mode, in which an image is formed by sequentially transferring color toner images formed by developing members in an overlapping manner, and a mono mode, in which an image is formed by using one developing member. The developing member used in the mono mode develops the toner image to be transferred secondly or thereafter in the color mode, an exposure device exposes a non-image portion where the toner image is not formed on the surface of an image carrier at an exposure amount smaller than an exposure amount for an image portion where the toner image is formed, and, in the mono mode, the exposure amount at which the exposure device exposes the non-image portion of the image carrier in the case the image is formed in the mono mode is smaller than the color mode.

9 Claims, 6 Drawing Sheets

AFTER PASSING THROUGH TRANSFER POSITION

AFTER PASSING THROUGH CHARGING POSITION

AFTER PASSING THROUGH EXPOSURE POSITION

AFTER PASSING THROUGH TRANSFER POSITION

AFTER PASSING THROUGH CHARGING POSITION

AFTER PASSING THROUGH EXPOSURE POSITION

IMAGE FORMING APPARATUS HAVING NON-IMAGE PORTION EXPOSURE AMOUNT THAT IS LOWER IN MONO MODE THAN IN COLOR MODE

BACKGROUND OF THE INVENTION

1. Field of the Invention

The present disclosure relates to an image forming apparatus, such as a copying machine and a printer, having a function of forming an image on a recording material such as a sheet.

2. Description of the Related Art

Conventionally, in an electrophotographic image forming apparatus, due to advantages such as low ozone and low power consumption, an apparatus using a method employing a contact charging device has been put into practical use. The contact charging device is a charging member which abuts on a photosensitive member (image carrier) and to which voltage is applied to charge the photosensitive member. Particularly, a roller charging apparatus using a charging roller as the charging member has been widely used from the viewpoint of charging stability. Recently, from the viewpoint of low cost and space saving, a charging method (hereinafter, referred to as a DC charging method) in which only DC voltage is applied to the charging roller is used (Japanese Patent Application Laid-Open No. 8-171260).

However, in the DC charging method, it is difficult to uniform a potential difference (hereinafter, referred to as a transfer memory) of the photosensitive member after transferring, and the transfer memory may appear as an image.

The transfer memory is a phenomenon in which flow amounts of transfer current to the photosensitive member are different between a portion carrying the toner and a portion without the toner and thus a difference in potential appears on the photosensitive member after transferring, and the potential is not sufficiently made uniform during the charging process. As a consequence, the difference in potential appears on the image occurs. For this reason, conventionally, to uniform the surface potential of the photosensitive member after transferring, light neutralization is carried out by a memory removing unit. However, installation of the memory removing unit causes increase in size of an apparatus and increase in cost.

Accordingly, so-called background exposure is known as a method for suppressing the transfer memory without separately providing the memory removing unit (Japanese Patent Application Laid-Open No. 2008-8991). By the background exposure, while the photosensitive member is charged at a predetermined potential during the charging process, a portion carrying a toner image is exposed by an exposure unit and simultaneously, a blank portion in which the toner image is not formed is also exposed to a small light amount.

However, the photosensitive member is gradually subjected to optical-fatigue by the exposure. As a result, in a system of exposing the surface of the photosensitive member at all times like the background exposure, the decrease in photosensitivity due to the optical fatigue of the photosensitive member needs to be considered.

Recently, a long lifespan and high image quality of products have advanced, and users have become diversified. Accordingly, even in the photosensitive member, it is required that product performance remains stable for a long time. In order to achieve the long lifespan, it is important that the optical fatigue of the photosensitive member is reduced as much as possible and the decrease in sensitivity is suppressed.

SUMMARY OF THE INVENTION

The disclosure is made in view of the above-mentioned situation, and is directed to an image forming apparatus capable of stably forming an image for a long time by suppressing optical fatigue of an image carrier.

According to an aspect disclosed herein, an image forming apparatus forming an image on a recording material includes at least one image carrier, a charging device configured to charge the surface of the image carrier, an exposure device configured to expose the surface of the image carrier, and a plurality of developing members configured to form a toner image on the surface of the image carrier by supplying a toner to a latent image formed on the surface of the image carrier. The image forming apparatus can switch between a color mode, in which an image is formed by sequentially transferring the respective color toner images formed by the plurality of developing members to the recording material or an intermediate transfer member from the surface of the image carrier in an overlapping manner, and a mono mode, in which an image is formed with a monochromatic toner by using one developing member of the plurality of developing members. The developing member used in the mono mode is a developing member for developing a toner image to be secondly or thereafter transferred to the recording material or the intermediate transfer member in the color mode, the exposure device can expose a non-image portion where the toner image is not formed on the surface of the image carrier, at an exposure amount smaller than an exposure amount for an image portion where the toner image is formed, and when the developing member used in the mono mode forms the toner image on the surface of the image carrier, the exposure amount at which the exposure device exposes the non-image portion of the image carrier in the case the image is formed in the mono mode, is smaller than that in the case the image is formed in the color mode.

Further features and aspects of the present disclosure will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the disclosure and, together with the description, serve to explain the principles disclosed herein.

DESCRIPTION OF THE EMBODIMENTS

Various exemplary embodiments, features, and aspects will be described in detail below with reference to the drawings.

However, dimensions, materials, shapes, and relative layouts of constituent components discussed in the exemplary embodiments can be appropriately modified depending on various conditions or configurations of apparatuses to which the invention is applied, and the scope of the invention is not limited to the following exemplary embodiments.

<Overall Configuration of Image Forming Apparatus>

Figure 6:
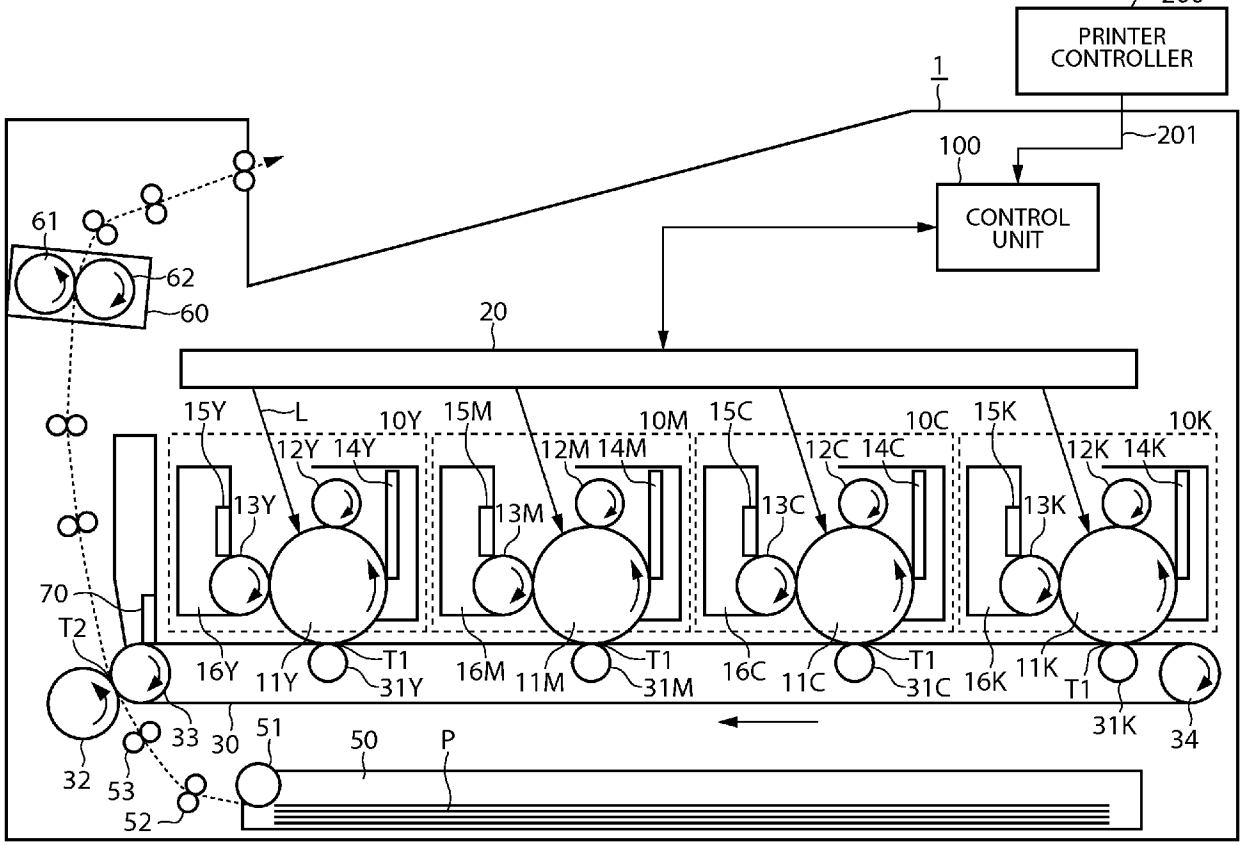
FIG. 6 is a cross-sectional view illustrating a schematic configuration of an image forming apparatus according to the exemplary embodiment.

FIG. 6 is a cross-sectional view illustrating a schematic configuration of an image forming apparatus 1 according to an exemplary embodiment.

In FIG. 6, the image forming apparatus 1 is a color laser beam printer having four imaging stations (image forming stations, image forming units). In the image forming apparatus 1, the image formation (image forming operation) is performed by using an electrophotographic process.

The image forming apparatus 1 outputs an image formed product by forming an image corresponding to image data (electric image information) on a recording material P as a recording medium. The image data is input from a printer controller 200 (external host device) connected to a control unit 100 through an interface 201. The control unit 100 is a unit for controlling an operation of the image forming apparatus 1. The control unit 100 transmits and receives various electric information signals to and from the printer controller 200. The control unit 100 also serves to process the electric information signals input from various process devices or sensors and command signals given to various process devices, perform predetermined initial sequence control, and predetermined imaging sequence control. The printer controller 200 includes a host computer, a network, an image reader, a fax machine, and the like.

The image forming apparatus 1 illustrated in FIG. 6 is configured as a so-called tandem type. In the tandem type apparatus, process cartridges (image forming units) 10Y, 10M, 10C, and 10K corresponding to four imaging stations are disposed in parallel at constant distances in a transverse direction (substantially horizontal direction).

Hereinafter, the process cartridges 10Y, 10M, 10C, and 10K will be described. The respective process cartridges 10Y, 10M, 10C, and 10K form toner images (developer images) of yellow (Y), magenta (M), cyan (C), and black (K). Here, configurations and operations of the respective process cartridges 10Y, 10M, 10C, and 10K are substantially the same, except that colors of the used toner (developer) are different. Accordingly, in the following description, when their distinctions are not particularly required, suffixes Y, M, C, and K given to reference numerals of FIG. 6 to represent any one color provided to each toner are omitted and collectively described.

The process cartridge 10 includes a photosensitive drum 11 as an image carrier, a charging roller 12 as a charging unit (charging device), a developing roller 13 as a developing unit (developing member), a developing blade 15, and a drum cleaner 14, which are integrated into the process cartridge 10 and are configured to be detachable from a main body of the image forming apparatus 1.

Here, the charging roller 12 is provided to uniformly charge the surface of the photosensitive drum 11 at a predetermined potential. The developing roller 13 is provided to carry a nonmagnetic one component toner (negative charging characteristic) to develop the electrostatic latent image formed on the photosensitive drum 11. The developing roller 13 forms the toner image on the surface of the photosensitive drum 11 by supplying the toner to an electrostatic latent image. The developing blade 15 is provided to uniform a toner layer on the developing roller 13. The drum cleaner 14 is provided to clean the surface of the photosensitive drum 11 after transferring.

Each photosensitive drum 11 is driven to rotate at a surface moving speed of 120 mm/sec in an arrow direction of the drawing by a driving unit (not illustrated). The toner is stored in a development container 16.

The photosensitive drum 11 is formed by film-coating an aluminum cylinder with a charge generation layer and a charge transport layer. The aluminum cylinder has an outer diameter of 30 mm as a base material and is grounded.

The charging roller 12 has a core bar and a conductive elastic body layer which is integrally formed concentrically around the core bar. The charging roller 12 is arranged substantially parallel to the photosensitive drum 11 and abuts on the photosensitive drum 11 at predetermined pressing pressure against elastic force of the conductive elastic body layer. Both ends of the core bar are rotatably bearing-supported, and the charging roller 12 is moved and rotated according to the rotation of the photosensitive drum 11. In the exemplary embodiment, DC voltage (direct current voltage) of about −1,000 V is applied to the core bar of the charging roller 12 as charging bias voltage.

The developing roller 13 has a core bar and a conductive elastic body layer which is integrally formed concentrically around the core bar, and is disposed substantially parallel to the photosensitive drum 11. The developing blade 15 is configured of a metallic thin plate made of SUS and has a free end abutting on the developing roller 13 at predetermined pressing pressure.

The developing roller 13 carries a toner which is negatively charged by friction to a development position facing the photosensitive drum 11. The developing roller is configured to contact and be separated from the photosensitive drum 11 by a contacting/separating mechanism (not illustrated). The developing roller 13 abuts on the photosensitive drum 11 during image forming, and DC voltage of about −300 V as development bias voltage is applied to the core bar of the developing roller 13.

Next, the main body of the image forming apparatus 1 will be described.

The image forming apparatus 1 of the exemplary embodiment includes a laser exposure unit 20 exposing the photosensitive drum 11 installed on each process cartridge 10, as an exposure unit (exposure device). A time-sequential electric digital pixel signal of image information, which is input to the control unit 100 through the interface 201 from the printer controller 200 and then image-processed, is input to the laser exposure unit 20.

The laser exposure unit 20 includes a laser output unit, a rotating polygon mirror (polygon mirror), an fθ lens, a reflecting mirror, and the like. The laser output unit outputs laser light L modulated according to the input time-sequential electric digital pixel signal. The laser exposure unit 20 exposes the surface of the photosensitive drum 11 by the laser light L in a main scanning direction. The electrostatic latent image corresponding to the image information is formed on the photosensitive drum 11 by the main scanning exposure and by sub scanning caused by rotation of the photosensitive drum 11.

An intermediate transfer belt 30 as an intermediate transfer member is disposed to abut on the photosensitive drum 11 of each process cartridge 10. The endless intermediate transfer belt 30 is formed by a resin film such as PVdf, nylon, PET, PC, or the like which has an electric resistance value (volume resistivity) of about $10^{11}$ to $10^{16}\Omega\cdot$cm and a thickness of 100 to 200 μm. Here, PVdf is polyvinylidene fluoride, PET is polyethyleneterephthalate, and PC is polycarbonate. Further, the intermediate transfer belt 30 is stretched by a drive roller 34 and a secondary transfer counter roller 33 and cyclically driven at a process speed when the drive roller 34 is driven by a motor (not illustrated) to rotate.

A primary transfer roller 31 is configured of a roller type in which the conductive elastic body layer is provided on a shaft. The primary transfer roller 31 is disposed to be substantially parallel to each photosensitive drum 11, and abuts on the photosensitive drum 11 across the intermediate transfer belt 30 at predetermined pressing pressure.

A transfer electric field is formed at the shaft of the primary transfer roller 31 by applying positive DC voltage.

A secondary transfer roller 32 is disposed to face the secondary transfer counter roller 33 across the intermediate transfer belt 30 and supported in a state where appropriate pressure is applied to the intermediate transfer belt 30.

A fixing unit 60 includes a fixing roller 61 heated by a fixed heater and a pressing roller 62 pressed to the fixing roller 61 at predetermined pressing pressure.

A belt cleaner 70 is disposed against a secondary transfer portion T2 (secondary transfer position) to remove the toner on the intermediate transfer belt 30 downstream in a rotation direction of the intermediate transfer belt 30.

A feeding unit includes a cassette 50 receiving the recording material P, a pickup roller 51 discharging the recording material P from the cassette 50 one by one, and a pair of feeding rollers 52 and 53 conveying the recording material P received from the pickup roller 51.

<Image Forming Process>

In the image forming apparatus 1, when the control unit 100 receives a print signal, operations of rotatively driven units such as the photosensitive drum 11 and the intermediate transfer belt 30 start and an image forming operation starts.

After the photosensitive drum 11 starts to rotate, charging bias is applied to the charging roller 12, and the surface of the photosensitive drum 11 is charged. When the charged surface of the photosensitive drum 11 reaches the exposure position, a laser element in the laser exposure unit 20 is turned on according to image information and the electrostatic latent image is formed on the surface of the photosensitive drum 11. The electrostatic latent image formed on the surface of the photosensitive drum 11 is developed and visualized by the toner on the developing roller 13 which rotates in contact with the photosensitive drum 11. The visualized toner image is transferred onto the intermediate transfer belt 30 by a potential difference with respect to the positive voltage applied to the primary transfer roller 31, at a primary transfer portion T1 (primary transfer position).

When forming a color image, the processes are sequentially performed at four process cartridges 10, and a plurality of colored toner images is transferred (formed) onto the intermediate transfer belt 30 to sequentially overlap with each other.

The toner images formed on the intermediate transfer belt 30 are collectively transferred onto the recording material P conveyed at a predetermined timing by the secondary transfer roller 32 to which the positive voltage is applied, at the secondary transfer portion T2. The toner images transferred onto the recording material P pass between the fixing roller 61 heated at a predetermined temperature and the pressing roller 62 pressed at predetermined pressure at the fixing unit 60, where the toner images are melted and fixed on the recording material P, and are conveyed to a discharge tray.

A process of cleaning a remaining toner on the photosensitive drum 11 and the intermediate transfer belt 30 after transferring is performed along with the above process. The toner which is not transferred but remains on the photosensitive drum 11 at the primary transfer portion T1 is removed by a blade member in the drum cleaner 14 installed on each process cartridge 10 to be collected in a cleaner container. Further, the toner which is not transferred onto the recording material P but remains on the intermediate transfer belt 30 at the secondary transfer portion T2 is removed by the blade member in the belt cleaner 70 to be collected in a cleaner container.

The image forming apparatus 1 of the exemplary embodiment is configured to switch between two modes. In a full color image forming mode (hereinafter, a color mode), an image is formed with four colors as a first mode, and in a mono image (hereinafter, a mono mode) an image is formed with a single color as a second mode. The switch of the color mode (first mode) and the mono mode is controlled by a signal transmitted to the control unit 100 from the printer controller 200.

In the mono mode, since the image forming operation is performed only by the black process cartridge 10K, there is no need to form images of yellow, magenta, and cyan. As a result, the developing roller 13 of the process cartridges 10 of yellow, magenta, and cyan is separated from the photosensitive drum 11 and stands by in a state where rotation driving force is not transferred. That is, the developing roller 13 is in a stopped state. Further, since the photosensitive drums 11 other than black abut on the intermediate transfer belt 30, the photosensitive drums 11 are rotatably driven so that a memory due to sliding friction is not generated. In this case, voltage is not applied to the charging roller 12.

Here, in the exemplary embodiment, as illustrated in FIG. 6, the black process cartridge 10K which performs the image forming operation in the mono mode is disposed most downstream in the rotation direction of the intermediate transfer belt 30 among the four process cartridges 10 which perform a series of image forming operations (on a sheet of recording material).

<Exposure Control>

The image forming apparatus 1 of the exemplary embodiment performs background exposure control which performs exposure at a smaller light amount than that of a toner image forming portion even in a blank portion, to suppress a ghost image generated by a sensitivity difference between the toner image forming portion and the blank portion on the surface of the photosensitive drum 11. Thus, the laser exposure unit 20 is installed to perform exposure at the smaller light amount than that of the toner image forming portion, even in the blank portion of the surface of the photosensitive drum 11. Here, the toner image forming portion corresponds to an image portion on the surface of the photosensitive drum 11, and the blank portion corresponds to a non-image portion where the toner image is not formed, on the surface of the photosensitive drum 11.

In the exemplary embodiment, a light amount LP received by the surface of the photosensitive drum 11 of the toner image forming portion is 0.320 $\mu J/cm^2$, and a background exposure amount BGLP1 is set to 0.015 $\mu J/cm^2$ which is smaller than the light amount LP.

Figure 2:
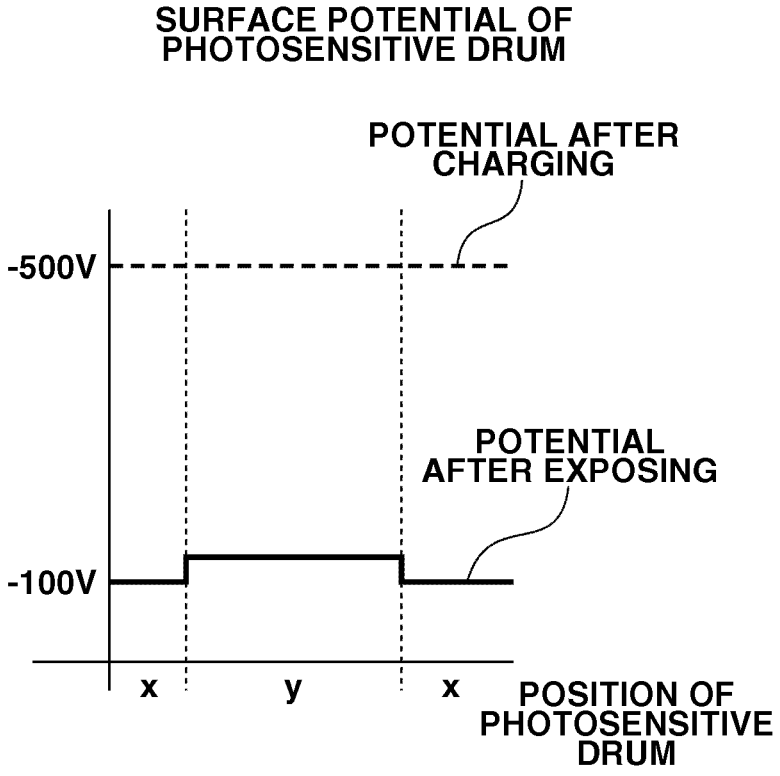
FIG. 2 is a diagram for describing sensitivity of a photosensitive drum.

FIG. 2 is a diagram for describing sensitivity of the photosensitive drum 11.

When exposure is performed in the next exposure process, the sensitivity of the photosensitive drum 11 may be different between a portion where laser is applied and a portion where the laser is not applied. In the previous process, at the portion where the exposure was performed, sensitivity is slightly decreased due to an effect caused by remaining charges and the like in the charge transport layer. As a result, as illustrated in FIG. 2, when the exposure is performed again in the exposure process, a difference in a potential appears after the exposure between the portion (y portion) where exposure is performed and the portion (x portion) where the exposure is not performed in the previous process. When the potential difference is increased, a density difference occurs in the finally formed image.

In order to suppress the phenomenon, the background exposure control which irradiates even the blank portion with laser, is performed where the toner image is not formed in the exposure process. Accordingly, since both the toner image forming portion and the blank portion are subjected to the exposure, a difference in sensitivity hardly occurs and the density difference may be suppressed. Even a small light amount of 0.015 $\mu J/cm^2$ as the background exposure amount BGLP1 is effective. In this case, a surface potential of the photosensitive drum 11 is decreased by about 20 to 30 V.

In the color mode, due to an effect of the toner image formed at an upstream station in the rotation direction of the intermediate transfer belt 30, the potential of the photosensitive drum 11 of the downstream station may be disturbed, and a defect image (transfer memory) may be generated. Hereinafter, this phenomenon will be described in detail.

When the color image is printed, a plurality of colors such as, for example, yellow and magenta when red is printed and output, magenta and cyan when blue is printed and output, and yellow and cyan when green is printed and output are overlapped with each other, and as a result, a desired color is output.

The imaging is performed by the respective process cartridges 10Y, 10M, and 10C of yellow, magenta, and cyan upstream in the rotation direction of the intermediate transfer belt 30 from the black process cartridge 10K.

As a result, when imaging is carried out in the black process cartridge 10K, the toner images of yellow, magenta, and cyan exist on the intermediate transfer belt 30 in advance. Thus, when a multi-colored toner is placed on the intermediate transfer belt 30, particularly, when a plurality of colored toners is overlapped with each other in large quantities (hereinafter, a multi colored portion), transfer current flowing from the primary transfer roller 31 to the photosensitive drum 11 through the intermediate transfer belt 30 becomes significantly smaller. Accordingly, due to a difference in a current amount flowing between the multi colored portion and the portion where the toner does not exist, a large difference in a surface potential of the photosensitive drum 11 after passing through the primary transfer position T1 is generated.

Figure 3A:
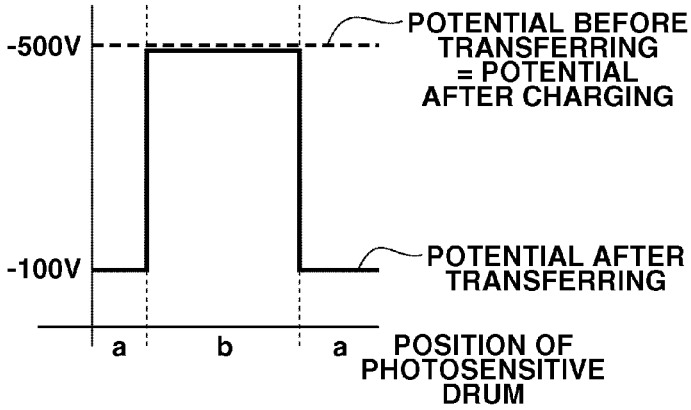
FIGS. 3A to 3C are diagrams for describing a surface potential of a photosensitive drum at a black station.
Figure 3B:
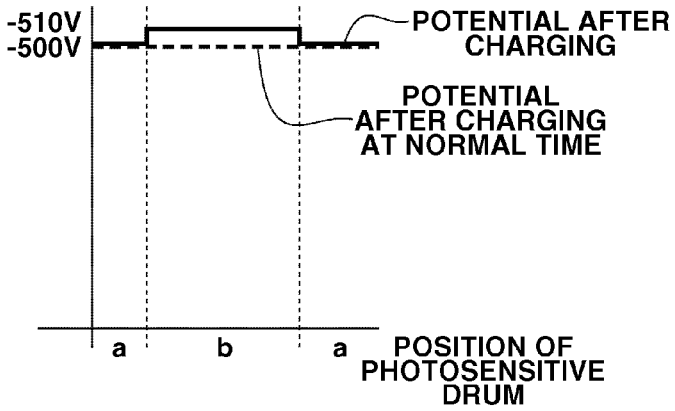
Figure 3C:
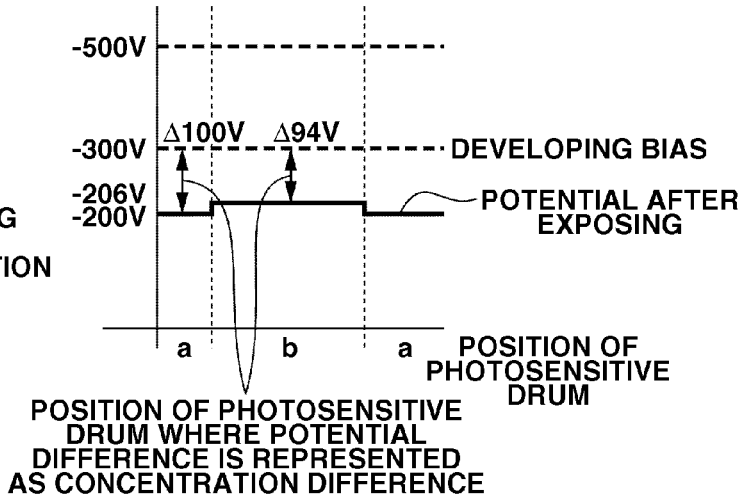

FIGS. 3A to 3C are diagrams illustrating a surface potential of the photosensitive drum 11 of the black process cartridge 10K and diagrams for illustrating a multi-colored toner transfer memory to be described below. In the drawings, a part a represents a portion where the toner does not exist, and a part b represents a potential of the multi colored portion.

FIG. 3A illustrates a potential after passing through the primary transfer position T1. A potential of the part a is changed up to about −100 V compared to a potential before passing through the primary transfer position T1. Meanwhile, a potential of the part b is slightly changed compared to a potential before passing through the primary transfer position T1 but is not largely changed. In this state, when the charging process is performed, as illustrated in FIG. 3B, the potential of the part b is higher than that of the part a by about 10 V.

Next, when the entire area is exposed to form a halftone density in the exposure process as illustrated in FIG. 3C, the potential state is slightly improved, but the potential difference of about 6 V is left. Therefore, when the developing process is performed in the state where the potential difference exists, an amount of the toner transferred from the developing roller 13 to the photosensitive drum 11 becomes different depending on a potential difference. Finally, the difference in the toner amount results in the density difference on the image, and the density of the part b is decreased as compared with the part a. The inventers name the phenomenon the multi-colored toner transfer memory and recognize that the phenomenon is a problem in forming the color image.

As a result of the study, the inventors found that the reason for the phenomenon is that the potential after charging is not uniform due to the potential difference generated after transferring. The phenomenon easily occur particularly, in a DC charging method (a charging method in which only DC voltage is applied to the charging roller 12 and AC voltage is not applied to the charging roller 12).

Figure 4:
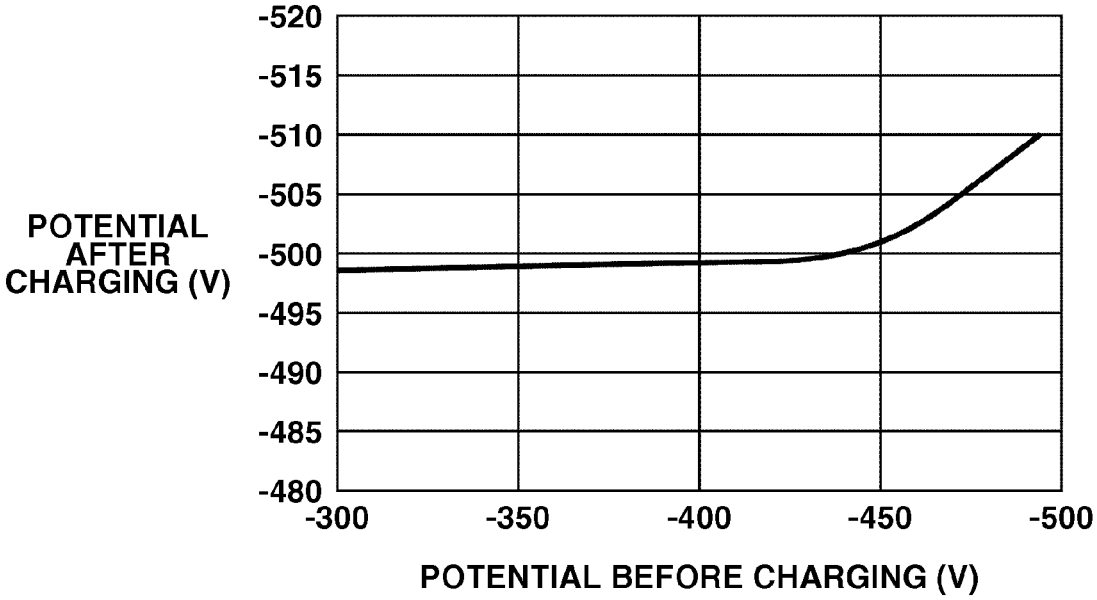
FIG. 4 is a diagram illustrating a relationship between a surface potential of the photosensitive drum before charging and a surface potential of the photosensitive drum after charging.

FIG. 4 is a diagram illustrating a relationship between a potential of the surface of the photosensitive drum 11 before charging and a potential thereof after charging, which was obtained by the study of the inventors. In an experiment, a surface potential of the photosensitive drum 11 when applying −1050 V as the charging voltage was measured under an environment of a temperature of 25 degrees and relative humidity of 50%. Referring to FIG. 4, it can be seen that when the potential before charging is close to the potential after charging, the potential is not stable. Generally, when the potential before charging is −440 V or less, the potential after charging is about −498 to −500 V, which is relatively stable. However, when the potential before charging exceeds −440 V, the potential gradually increases to exceed −500 V which is a target potential after charging. That is, when the difference between the target potential after charging and the potential before charging is equal to or larger than about 60 V, the potential after charging is stable, and when the difference is less than 60 V, the charging potential is gradually increased. A phenomenon in which the potential is increased to be higher than the target potential after charging, is referred to as "overcharging".

As illustrated above, the multi-colored toner transfer memory appears, since the surface potential of the photosensitive drum 11 before charging at the portion where the toner exists maintains substantially the same potential as the potential after charging, and overcharging and a difference in the potential after charging occur.

The inventors found that the aforementioned background exposure control is effective as a means for suppressing the multi-colored toner transfer memory. Next, a mechanism of suppressing the multi-colored toner transfer memory by the background exposure control will be described.

Figure 5A:
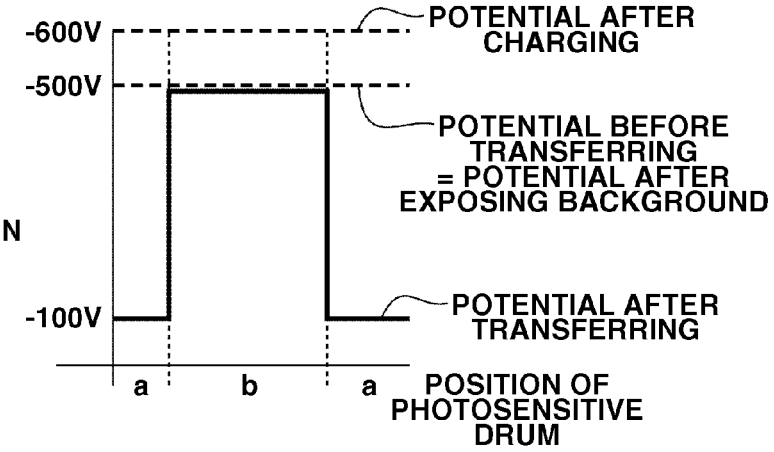
FIGS. 5A-C are diagrams illustrating a surface potential of a photosensitive drum at a black station according to the exemplary embodiment.
Figure 5B:
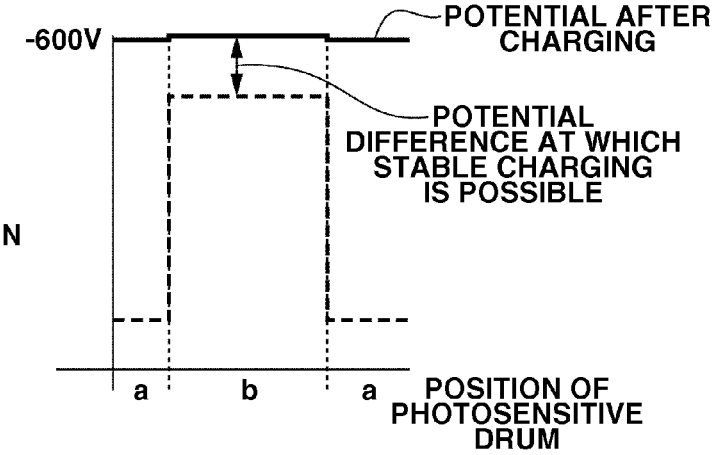
Figure 5C:
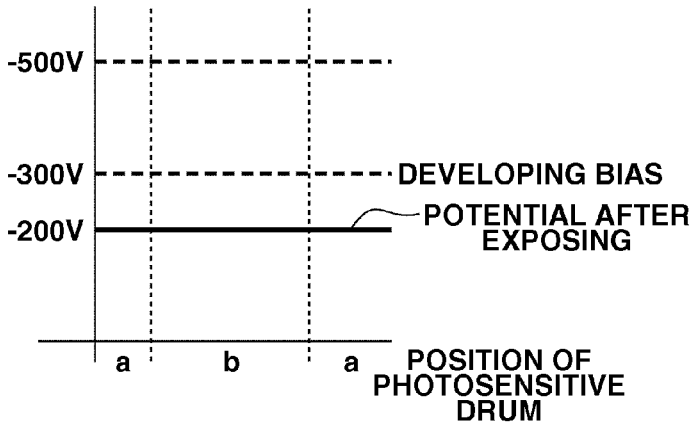

FIGS. 5A to 5C correspond to FIGS. 3A to 3C, and illustrate a surface potential of the photosensitive drum of the black process cartridge 10K when background exposure is performed in the exemplary embodiment. As illustrated in FIG. 5A, the surface potential after charging is about −600 V and the background exposure is performed at a light amount slightly larger than a general background exposure amount when undergoing the exposure process. As a result, when reaching the primary transfer portion, the surface potential of the photosensitive drum 11 is decreased up to −500 V. At this time, the background exposure amount is 0.055 $\mu J/cm^2$. The potential after passing through the primary transfer portion T1 becomes approximately the same potential as that of FIG. 3A, and a large potential difference between the part a and the part b occurs.

FIG. 5B illustrates a potential after passing through the charging position. A potential difference between the part a and the part b before charging exists. However, since a potential difference from the target charging potential sufficiently exists even in the part b, uniform charging is possible and the charging potential is almost uniform. Naturally, as illustrated in FIG. 5C, the potential is uniform even after performing exposure for forming a halftone density in the exposure process, and the density difference does not appear even in the final image.

That is, as described with reference to FIG. 4B, when a difference between the target potential after charging and the potential before charging is about 60 V or more, stable charging is possible. Accordingly, in the exemplary embodiment, since the difference between the target charging potential and the potential before charging are certainly set to 100 V or more to always decrease the potential after charging by about 100 V by the background exposure, the potential after charging can maintain the target charging potential.

<Problem of Background Exposure>

However, in the background exposure performed to suppress the multi-colored toner transfer memory, a laser needs to be applied to change a potential of about 100 V at all times. Accordingly, the photosensitive drum 11 is irradiated with the laser at a slightly large light amount at all times. Particularly, when a long lifespan is required, the charge transfer layer of the photosensitive drum 11 and the charge generation layer therebelow may be subjected to optical-fatigue.

In the optically-fatigued photosensitive drum 11, since sensitivity deteriorates, a required contrast (hereinafter, a development contrast) between a development bias and a dark portion potential may not be secured and a phenomenon in which the density becomes light may occur. Further, in the optically-fatigued photosensitive drum 11, the potential after charging decreases with time and when the photosensitive drum 11 reaches the development position, a desired contrast (hereinafter, a back contrast) between a development bias and a light portion potential may not be secured and a fogging phenomenon in which the toner is developed even in the blank portion may occur.

Further, in achieving a long lifespan of the main body of the image forming apparatus 1, since a light emitting time is increased by the background exposure, a laser element deteriorates and the light amount is decreased. Even in this case, sufficient development contrast may not be secured and the density is decreased.

Further, to perform the background exposure, first, the surface potential of the photosensitive drum 11 needs to be larger than the target charging potential in a negative value. Accordingly, more discharging amount is required during charging than in normal, and the surface of the photosensitive drum 11 deteriorates and is easily scraped.

<Background Exposure Control>

Hereinafter, a method of reducing a background exposure amount maximally to solve the problem of the background exposure control for the purpose of the long lifespan, which is a feature of the exemplary embodiment will be described.

As described above, only a color mode requires the background exposure at a large light amount due to the multi-colored toner transfer memory.

Accordingly, in the exemplary embodiment, in the black process cartridge 10K, the background exposure is controlled to be performed at a smaller exposure amount in the mono mode, compared with the color mode. Herein, in the exemplary embodiment, the exposure amount in the mono mode is the same as the exposure amount of a general background exposure.

Figure 1:
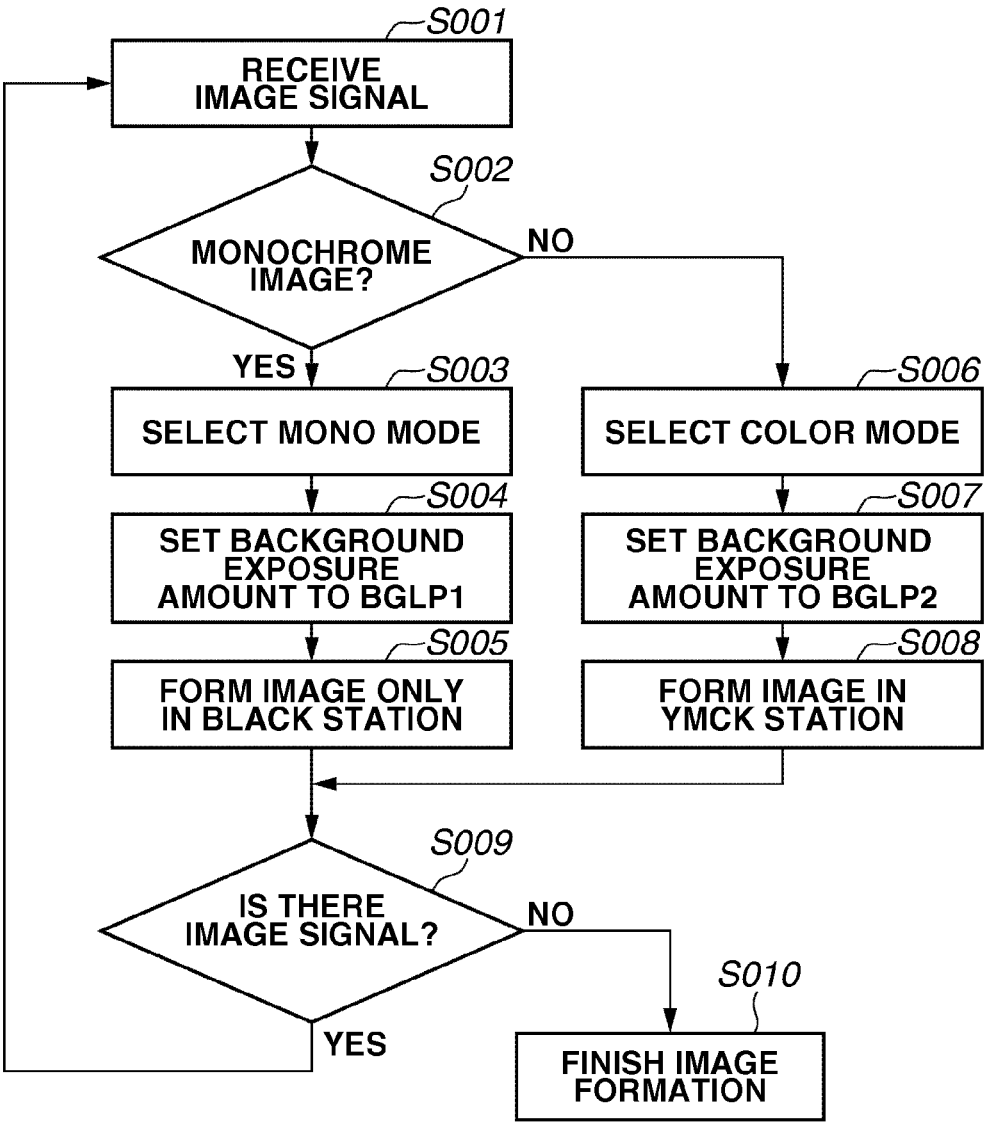
FIG. 1 is a diagram illustrating a flowchart of an image forming operation according to an exemplary embodiment.

FIG. 1 is a diagram illustrating a flowchart of an image forming operation performed by the control unit 100 in the exemplary embodiment.

Hereinafter, the image forming operation of the exemplary embodiment will be described in detail with reference to FIG. 1.

In step S001, first, information on image forming transmitted from the printer controller 200 is received by the control unit 100. The received information includes information for determining whether an image to be formed is a color image or a monochrome image. In step S002, when the image is the color image (NO in step S002), the control unit 100 selects the color mode, and when the image is the monochrome image (YES in step S002), the control unit 100 selects the mono mode. In step S003, when the mono mode is selected, the background exposure amount is set to a first light amount BGLP1 of 0.015 $\mu J/cm^2$ in step S004, and only the black station (black process cartridge 10K) forms the image in step S005. In step S006, when the color mode is selected, in the black station (black process cartridge 10K), the background exposure amount is set to a second light amount BGLP2 of 0.055 $\mu J/cm^2$ in step S007. In addition, in step S008, all stations (all process cartridges 10) form the images.

After forming the image, in step S009, it is determined whether the next image signal exists, and when the image signal exists (YES in step S009), the process returns to step S001 and the process is repeated. When the image signal does not exist, the image forming operation ends in step S010.

By performing such control, while quality of the color image is maintained, a laser emitting amount of the black station and the exposure amount received by the photosensitive drum 11 may be reduced. This has an effect of addressing decrease in sensitivity due to optical fatigue of the photosensitive drum 11, reduction of the charging potential, deterioration of the laser element, and increase in a scraping amount of the surface of the photosensitive drum 11, which are problems arising from the long lifespan. For example, when printing is performed under a condition that a ratio of the mono mode and the color mode is half, the laser emitting amount may be suppressed about 30%, as compared with the conventional background exposure performed at one exposure amount (i.e., the exposure amount in the color mode) regardless of the mono mode and the color mode.

As a result, a laser lifespan may be extended to about 60 to 70%.

Further, similarly, since an amount of light received by the photosensitive drum 11 may be reduced, there is an effect of suppressing the decrease in the sensitivity of the photosensitive drum 11.

When in both the color mode and the mono mode, 2500 sheets are printed respectively (total 5000 sheets), and the exposure amount is not changed according to the mode in a conventional manner in the background exposure, the sensitivity is decreased about 30 V. On the contrary, the decrease in the sensitivity was suppressed about 15 V by changing the exposure amount to the small background exposure amount in the mono mode.

Even the reduction of the charging potential is improved while the amount of received light of the photosensitive drum is decreased. It was confirmed that the carving amount of the photosensitive drum tends to be decreased by about 15%.

In a color printer, a black printing ratio is the highest, and the number of printed sheets in the mono mode is relatively large. Accordingly, the long lifespan of the photosensitive drum of the black station and the long lifespan of the laser are very important.

In the exemplary embodiment, as described above, in the black station, a light amount of the background exposure amount is changed between the color mode and the mono mode, and the mono mode. In the mono mode, which does not require a large background exposure amount, the background exposure is performed at a small light amount. As a result, the amount of received light of the photosensitive drum in the black station may be suppressed and the light emitting amount of the laser element may also be suppressed.

Accordingly, while the quality of the color image is improved, the long lifespan of the photosensitive drum in the black station and the long lifespan of the laser element may be achieved, and more stable image formation can be performed for a long time.

Here, in the exemplary embodiment, the background exposure is performed even in the mono mode, but the background exposure may not be performed in the mono mode if there is no large problem regarding image quality even when the background exposure is not performed. In the mono mode, if no background exposure is performed, degradation of the photosensitive drum by light may be suppressed and the lifespan of the laser element may be extended.

Further, in the exemplary embodiment, the image forming apparatus having the configuration in which primary transfer is performed on the intermediate transfer belt is described. However, the image forming apparatus to which the invention can be applied is not limited thereto. The embodiment disclosed herein may be appropriately applied also to an image forming apparatus having a configuration of directly transferring the image from the photosensitive drum to the conveyed recording material P.

Further, in the exemplary embodiment, the image forming apparatus having the configuration in which the imaging stations are arranged in a row is described. However, the invention is not limited thereto. The embodiment disclosed herein may be appropriately applied to a rotary development type image forming apparatus in which a plurality of developing units is installed on one photosensitive drum, and the developing operation is performed on one photosensitive drum by switching sequentially developing units.

Further, in the exemplary embodiment, the black process cartridge 10K is disposed most downstream in the rotation direction of the intermediate transfer belt 30 among the four process cartridges 10, but the invention is not limited thereto. It is sufficient that other process cartridges are disposed upstream in the rotation direction of the intermediate transfer belt 30 from the black process cartridge 10K. That is, it is sufficient that the black process cartridge 10K is a cartridge other than a process cartridge which forms a toner image to be transferred first onto the intermediate transfer belt 30 among the plurality of process cartridges when the image is formed in the color mode. That is, it is sufficient that the black process cartridge 10K is configured to transfer the image onto the intermediate transfer belt 30 secondly or thereafter.

Further, in the exemplary embodiment, DC voltage is applied to the core bar of the charging roller 12 as charging bias voltage, but the invention is not limited thereto. However, as described above, since the multi-colored toner transfer memory tends to occur, particularly, in the DC charging, it is more effective when the aforementioned control is performed in the DC charging.

According to the disclosure, it is possible to more stably form an image for a long time by suppressing optical fatigue of an image carrier.

While the present disclosure has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2012-098870 filed Apr. 24, 2012, which is hereby incorporated by reference herein in its entirety.

What is claimed is:

1. An image forming apparatus forming an image on a recording material, the apparatus comprising:

at least one image carrier;

a charging device configured to charge the surface of the image carrier;

an exposure device configured to expose the surface of the image carrier; and a plurality of developing members configured to form a toner image on the surface of the image carrier by supplying a toner to a latent image formed on the surface of the image carrier, wherein the image forming apparatus can switch between a color mode, in which an image is formed by sequentially transferring respective color toner images formed by the plurality of developing members to the recording material or an intermediate transfer member from the surface of the image carrier in an overlapping manner, and a mono mode, in which an image is formed with a monochromatic toner by using one developing member of the plurality of developing members, the developing member used in the mono mode is a developing member for developing the toner image to be secondly or thereafter transferred to the recording material or the intermediate transfer member in the color mode, the exposure device can expose a non-image portion where the toner image is not formed on the surface of the image carrier, at an exposure amount smaller than an exposure amount for an image portion where the toner image is formed, and when the developing member used in the mono mode forms the toner image on the surface of the image carrier, the exposure amount at which the exposure device exposes the non-image portion of the image carrier in the case the image is formed in the mono mode, is smaller than that in the case the image is formed in the color mode.

2. The image forming apparatus according to claim 1, wherein, when the image is formed in the mono mode, the exposure device does not expose the non-image portion of the image carrier.

3. The image forming apparatus according to claim 1, wherein the charging device charges the surface of the image carrier only with DC voltage.

4. The image forming apparatus according to claim 1, further comprising a plurality of image carriers, wherein toner images are formed on the plurality of image carriers by different developing members.

5. The image forming apparatus according to claim 1, wherein the plurality of developing members forms toner images on the same image carrier.

6. The image forming apparatus according to claim 1, wherein the plurality of developing members takes cartridge forms, and is are detachable from an apparatus body of the image forming apparatus.

7. The image forming apparatus according to claim 1, wherein a black toner is used in the mono mode, and yellow, magenta, cyan, and black toners are used in the color mode.

8. The image forming apparatus according to claim 1, wherein the developing member used in the mono mode forms a toner image which is last superimposed in the color mode.

9. The image forming apparatus according to claim 1, wherein, in the color mode, the exposure device exposes the non-image portion of the image carrier to change a potential of the non-image portion by 60 V or more, and in the mono mode, the exposure device does not expose the non-image portion of the image carrier, or when the exposure device exposes the non-image portion of the image carrier, a variation in the potential of the non-image portion due to the exposure is smaller than 60 V.

* * * * *